US006662390B1

(12) United States Patent
Berger

(10) Patent No.: US 6,662,390 B1
(45) Date of Patent: Dec. 16, 2003

(54) INFANT SLEEPING AND RECEIVING BLANKET

(76) Inventor: Catherine Ann Berger, 4000 E. Charter Oak Dr., Orange, CA (US) 92869-2612

( * ) Notice: Subject to any disclaimer, the term of this patent is extended or adjusted under 35 U.S.C. 154(b) by 0 days.

(21) Appl. No.: 10/113,520

(22) Filed: Apr. 1, 2002

(51) Int. Cl.[7] ..... A47G 9/00; A41B 13/06

(52) U.S. Cl. ..... 5/486; 5/482; 5/655; 2/69; 2/69.5; 2/75

(58) Field of Search ..... 5/413 R, 655, 5/494, 482, 486; 2/69, 69.5, 75

(56) References Cited

U.S. PATENT DOCUMENTS

| | | | | | |
|---|---|---|---|---|---|
| 1,583,419 | A | | 5/1926 | Perl | |
| 1,584,853 | A | | 5/1926 | Derr | |
| 1,678,125 | A | | 7/1928 | Petrescu | |
| D109,371 | S | | 4/1938 | Friedman | |
| 2,227,751 | A | | 1/1941 | Idelman | |
| 3,034,132 | A | | 5/1962 | Landsberger et al. | |
| 3,412,407 | A | | 11/1968 | Key | |
| 4,254,900 | A | * | 3/1981 | Wheeler | 224/158 |
| 4,295,230 | A | | 10/1981 | Blodgett | |
| 4,773,101 | A | * | 9/1988 | Kapp et al. | 2/69.5 |
| 4,897,885 | A | | 2/1990 | Lunt | |
| 4,979,250 | A | | 12/1990 | Troncone et al. | |
| 5,046,204 | A | | 9/1991 | Mohler | |
| 5,129,406 | A | * | 7/1992 | Magnusen et al. | 128/873 |
| 5,131,096 | A | * | 7/1992 | Olson | 2/75 |
| D355,068 | S | | 2/1995 | Prendergast | |
| 5,692,257 | A | * | 12/1997 | Albertieri | 5/655 |
| 5,722,094 | A | | 3/1998 | Ruefer | |
| 5,852,827 | A | | 12/1998 | Lear | |
| 6,009,576 | A | | 1/2000 | Gramme et al. | |
| 6,145,932 | A | * | 11/2000 | Hamel-Nyhus et al. | 297/465 |
| D448,142 | S | | 9/2001 | Callan | |
| 6,341,397 | B1 | * | 1/2002 | Kliegl et al. | 5/482 |
| 6,389,597 | B1 | * | 5/2002 | Henegan | 2/69.5 |

* cited by examiner

*Primary Examiner*—Teri Pham Luu

(57) ABSTRACT

A blanket comprising of a sheet of fabric of predetermined shape folded vertically, into three sections, and at the base of the folded fabric a gusset is attached. The folded fabric consists of a central area, a right-hand side and a left-hand side. Together, the central area, the right-hand side and the left-hand side make up the securing compartment. Attached to the front base of the folded fabric is a T-shaped wrapping flap with right and left securing flaps. The right-hand side and left-hand side of the folded fabric may include hook and loop fasteners for securing an infant inside the securing compartment. The right and left securing flaps of the T-shaped wrapping flap include hook and loop fasteners that wrap around the sides and the back of the securing compartment and overlap and join in the back of the securing compartment, and thus, the back of the infant. T-shaped wrapping flap may be eliminated and replaced with two additional flaps; a right alternative flap and a left alternative flap. The alternative flaps may have many shapes and sizes, ranging from wide and oval, to narrow and rectangular. The alternative flaps overlap and join in the front of the securing compartment, and thus, in front of the infant.

11 Claims, 11 Drawing Sheets

INFANT SLEEPING AND RECEIVING BLANKET

FEDERALLY SPONSORED RESEARCH

Not Applicable

SEQUENCE LISTING OR PROGRAM

Not Applicable

BACKGROUND

1. Field of Invention

This invention relates generally to blankets, specifically to a blanket used for securing a newborn or small infant.

2. Description of Prior Art

It is generally known that babies like to be swaddled to be kept warm and to mimic the environment of their mother's womb. Swaddling a baby has been done in the past using traditional square blankets, but there are some disadvantages to this approach. For example, square blankets do not stay in place, and so much of the material from the blankets remains unused, resulting in wasted material.

The traditional square blanket does not allow the baby to sleep covered, and an older, more active infant will quickly kick off the covers, becoming cold enough to wake up in the middle of the night. As an infant learns to sit up, the traditional square blanket will not stay secure to the infant. A traditional square blanket will not protect an infant against drafts and colder temperatures while playing close to the floor.

Several challenges occur in trying to create a non-traditional swaddling blanket. First, infants vary in height and weight, and the blanket needs to accommodate these differences. A "one size fits all" blanket is needed. Secondly, the blanket needs to keep the infant warm but not allow the infant to overheat. Such overheating would put an infant in serious danger. In addition, the blanket needs to securely attach to the infant, and stay attached as the infant gets more active. Finally, a blanket is needed that can accommodate the changing lifestyle of an infant; (a) the fragile newborn, (b) the wakefulness and kicking of an older baby, (c) the exposure to drafts and colder temperatures for the baby who wants to play on the floor, (d) the desire to be warm and swaddled for the baby who likes to be held and passed around from one adult to another, (e) the curious baby ready to see the outdoors, and finally, (f) the sleeping baby who wants to be warm throughout the whole night.

Several attempts at creating a non-traditional swaddling blanket have been attempted, yet a truly satisfactory blanket has heretofore not been developed. U.S. patents covering various types of swaddling blankets do exist. These include U.S Pat. No. 6,009,576, to Gramme et al., issued Jan. 4, 2000, discloses a body-conforming wrapping article for infants. This article forms a pouch by using wrapping flaps that are secured around the infant by using hook and loop fasteners. In this particular design an infant can kick his way out at the bottom, allowing the infant's feet to become cold. U.S. Pat. No. 5,852,827, to Lear, issued Dec. 29, 1998, discloses a baby wrapping blanket. This blanket consists of two flaps that are folded around an infant. An excess amount of material is used which doesn't allow for freedom of movement of the baby's arms and legs. U.S Pat. No. 1,583,419. to Perl, issued May 4, 1926, discloses a sleeping bag device. This device consists of a mattress portion and a cover portion. This device confines an infant too securely, allowing an infant's safety to be in question.

Other known U.S. Patents are U.S. Pat. No. 1,584,853, to Dern, issued May 18, 1926, discloses an infant's wrap. This wrap forms a pouch for the infant by using wrapping flaps that wrap around the infant's feet, and both the right and left sides of the body. This design for this wrap is complex, and poses a choking hazard for an infant because the infant's wrap contains small parts. Also in this design, it would be difficult for an infant to sit still long enough for an adult to finish all the steps needed to secure the infant in the wrap.

Still other known U.S. Patents are U.S. Pat. No. 2,227,751, to Idelman, issued Jan. 7, 1941, discloses a combination infant's garment and blanket. This garment and blanket consists of a zipper pouch for an infant's body, a hood, and a folded-up foot pouch. This design is too secure and does not allow much circulation of air when all the zippers, strings, and snaps are fastened.

OBJECTS AND ADVANTAGES

Accordingly, several objects and advantages of my invention are:

(a) to provide a blanket with a gusset, which creates a three dimensional blanket, that will allow an infant to have freedom of movement while keeping the infant comfortable, warm, and secure.

(b) to provide a blanket with securing flaps, which will allow an infant to stay covered while sleeping, keeping the infant from kicking the blanket off.

(c) to provide a blanket comprising of hook and loop fasteners that allow the blanket to stay secure around the infant, provide adjustability for the varying sizes and shapes of each unique infant. Hook and loop fasteners will also provide the necessary adjustment to match the rapid growth rate of the infant.

(d) to provide a blanket comprising of vertically folded fabric, which allows an infant to be snuggly or loosely wrapped for maximum comfort.

(e) to provide a blanket with the option of one or more layers, which allows an infant to be protected from cold drafts and temperatures, while being safe from overheating.

(f) to provide a blanket which does not contain any removable parts or fancy decorations, keeping baby safe from choking and potential strangulation.

Other objects and advantages are ease of use. The blanket contains no complicated directions or folds. The blanket is easy to place baby in, even if the baby wiggles and squirms. The blanket is easy and quick to assemble, so as not to upset an infant. The blanket is a multipurpose blanket. It comprises of hook and loop fasteners for adjustability, allowing it to be used with the baby's arms inside, or outside the blanket. The blanket can wrap around the upper body or just the lower body to keep the legs warm. The diverse fabric selection creates a blanket that can be used both indoors and outdoors. The blanket is beneficial to newborns or older infants, who may still wear the blanket comfortably while sitting up and playing. This blanket is carefully shaped, so there is no excess material, and therefore, no wasted material.

Further objects and advantages of my invention will become apparent from a consideration of the drawings and ensuing description.

SUMMARY OF THE INVENTION

In accordance a blanket comprises a sheet of fabric of predetermined shape folded vertically, into three sections, and at the base of the folded fabric a gusset is attached. The folded fabric consists of a central area, a right-hand side and a left-hand side. Together, the central area, the right-hand side and the left hand side make up the securing compartment. Attached to the front base of the folded fabric is a T-shaped wrapping flap with right and left securing flaps. The right-hand side and left-hand side of the folded fabric may include hook and loop fasteners for securing an infant inside the securing compartment. The right and left securing flaps of the T-shaped wrapping flap include hook and loop fasteners that wrap around the sides and the back of the securing compartment. Both T-shaped wrapping flaps overlap and join in the back of the securing compartment, and thus, the back of the infant.

REFERENCE NUMERALS IN DRAWINGS

| | |
|---|---|
| 10 blanket | 26 right hook and loop fastener |
| 12 securing compartment | 28 left hook and loop fastener |
| 13 gusset | 30 right hook and loop fastener on T-shaped wrapping flap |
| 14 right-hand side | 32 left hook and loop fastener on T-shaped wrapping flap |
| 15 base | 34 right alternative flap |
| 16 left-hand side | 36 left alternative flap |
| 18 central area | 38 right seam |
| 20 T-shaped wrapping flap | 40 left seam |
| 22 right securing flap | 42 hood |
| 24 left securing flap | |
| 25 elastic band | |

DETAILED DESCRIPTION

Description-FIGS. 1A-1B-2A-2B-3-Preferred Embodiment

Figure 1A:
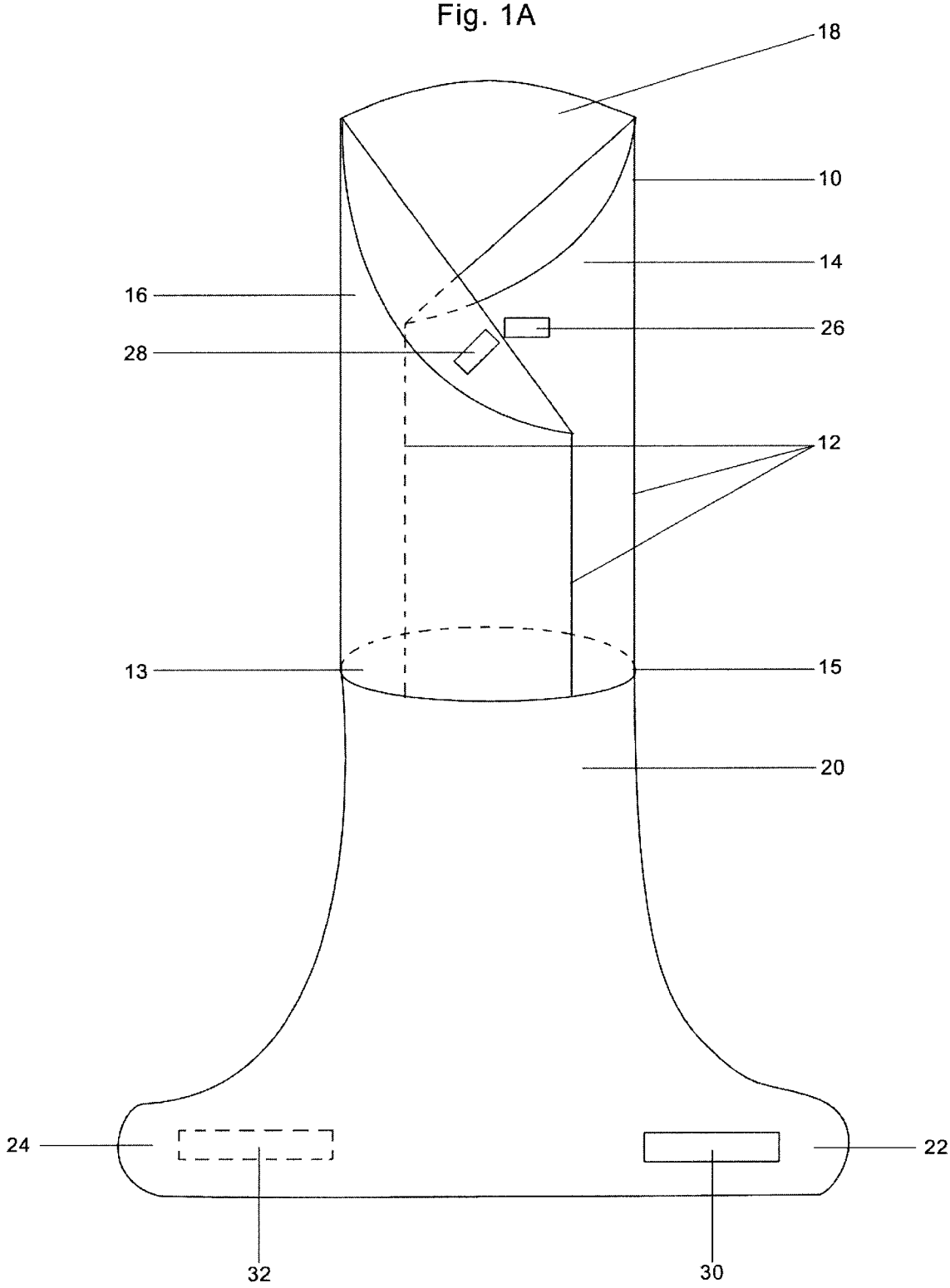
FIG. 1A is a plan view of the preferred embodiment of blanket 10 in a flat or fully opened position.

A preferred embodiment of the blanket of the present invention is illustrated in FIG. 1A which is shown in its unwrapped or fully opened position. Blanket 10 can be considered as comprising generally of a securing compartment 12, which comprises a sheet of fabric of predetermined shape, folded vertically into three sections, sewn together at base 15 and sewn to gusset 13. Securing compartment 12 is made up of right-hand side 14, left-hand side 16, and central area 18. Securing compartment 12 and gusset 13, when sewn together, create a three dimensional blanket.

Figure 1B:
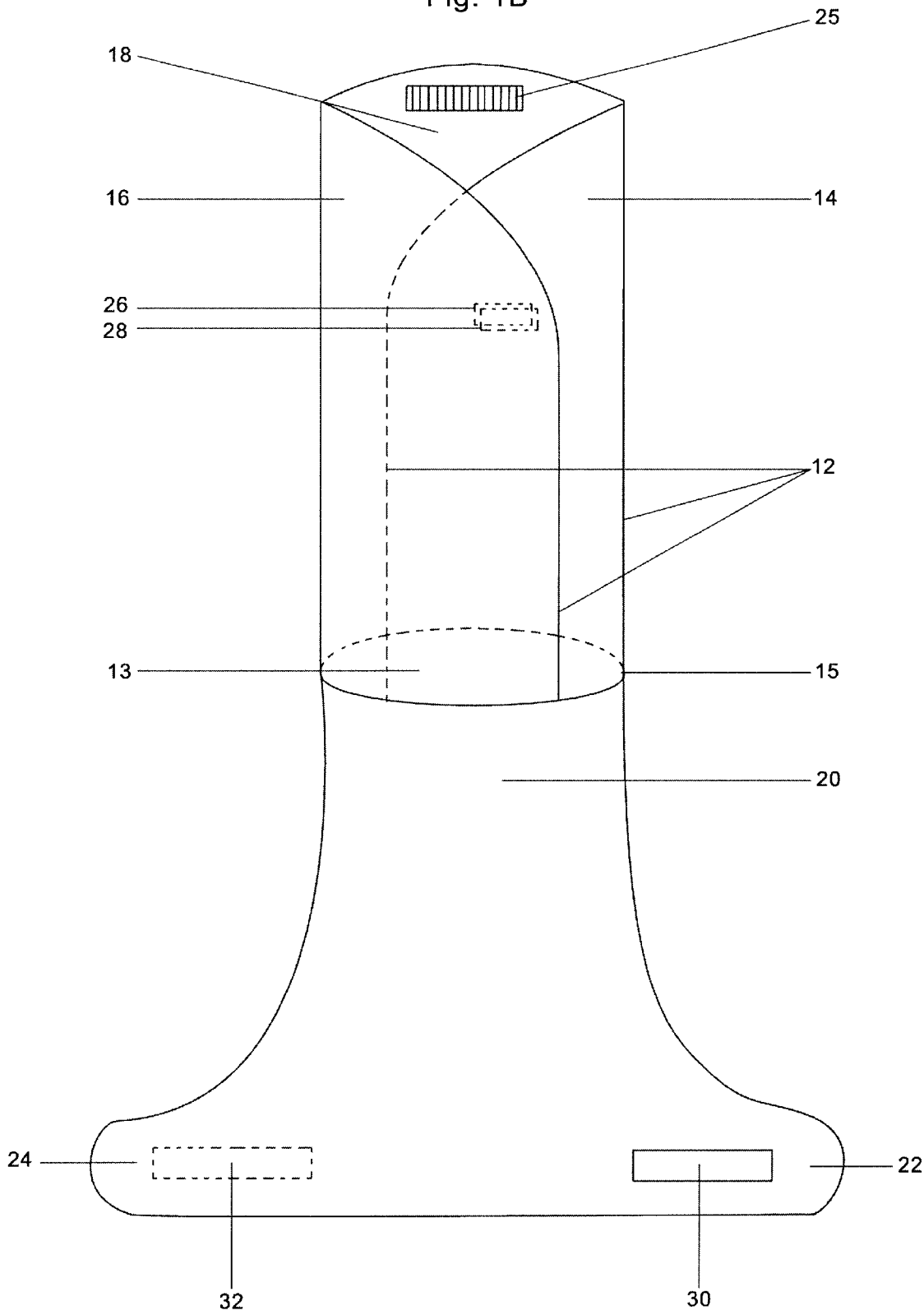
FIG. 1B is a plan view similar to FIG. 1A, with blanket 10 being in an intermediate stage of enclosure.

Right-hand side 14 and left-hand side 16 may further have mating hook and loop fasteners, that when joined, provide a secure attachment. The infant is secure inside securing compartment 12 by the joining of right hook and loop fastener 26 to left hook and fastener 28. Right-hand side 14 and left-hand side 16 may contain no hook and loop fasteners or more than one set of fasteners depending on the size of the infant. Attached to base 15 and gusset 13 is T-shaped wrapping flap 20. T-shaped wrapping flap 20 contains right securing flap 22 and left securing flap 24, as shown in FIGS. 1A and 1B. T-shaped wrapping flap 20 is shown in its opened or unused position, with hook and loop fasteners 30 attached to the ends of right securing flap 22 and hook and loop fastener 32 attached to left securing flap 24.

Figure 2A:
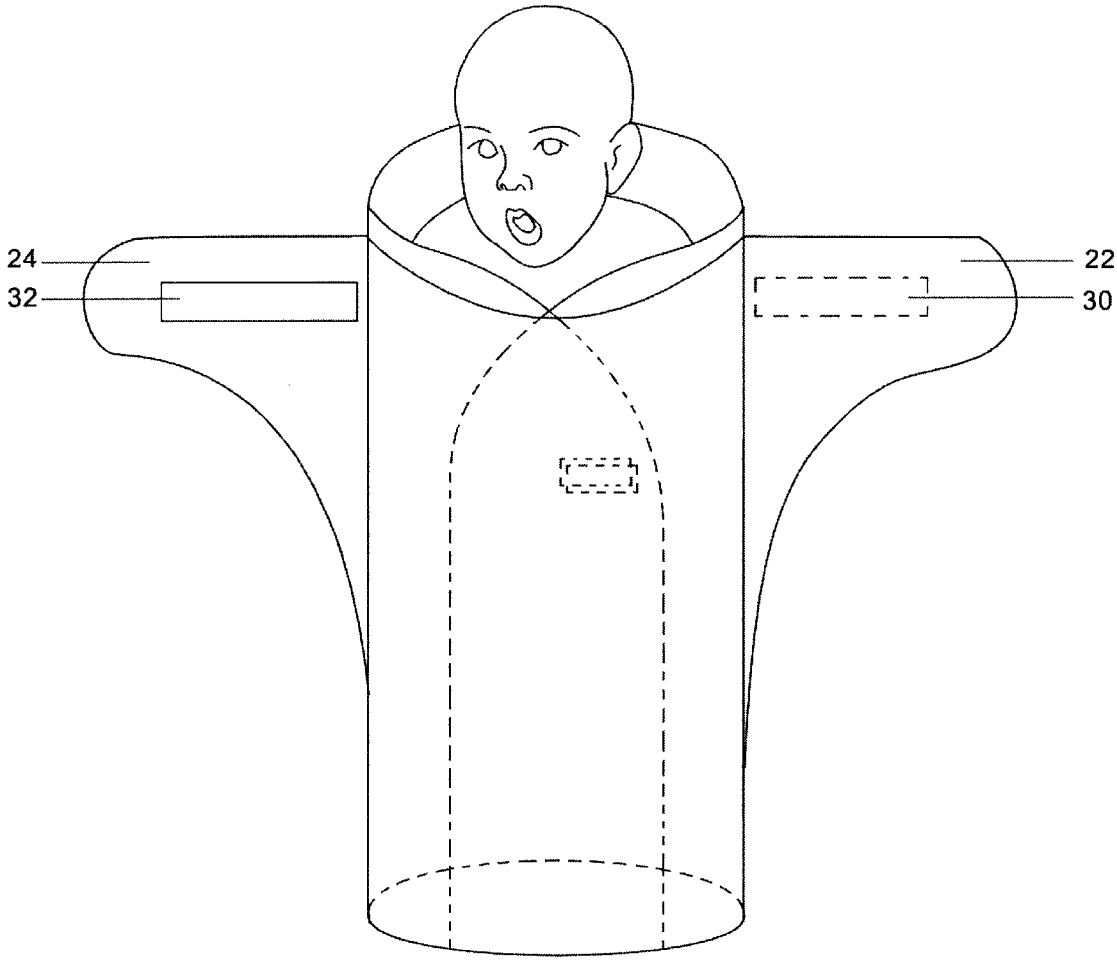
FIG. 2A is a plan view of blanket 10, with T-shaped wrapping flap 20 shown folded up over securing compartment 12 with right securing flap 22 and left securing flap 24 shown unattached.
Figure 2B:
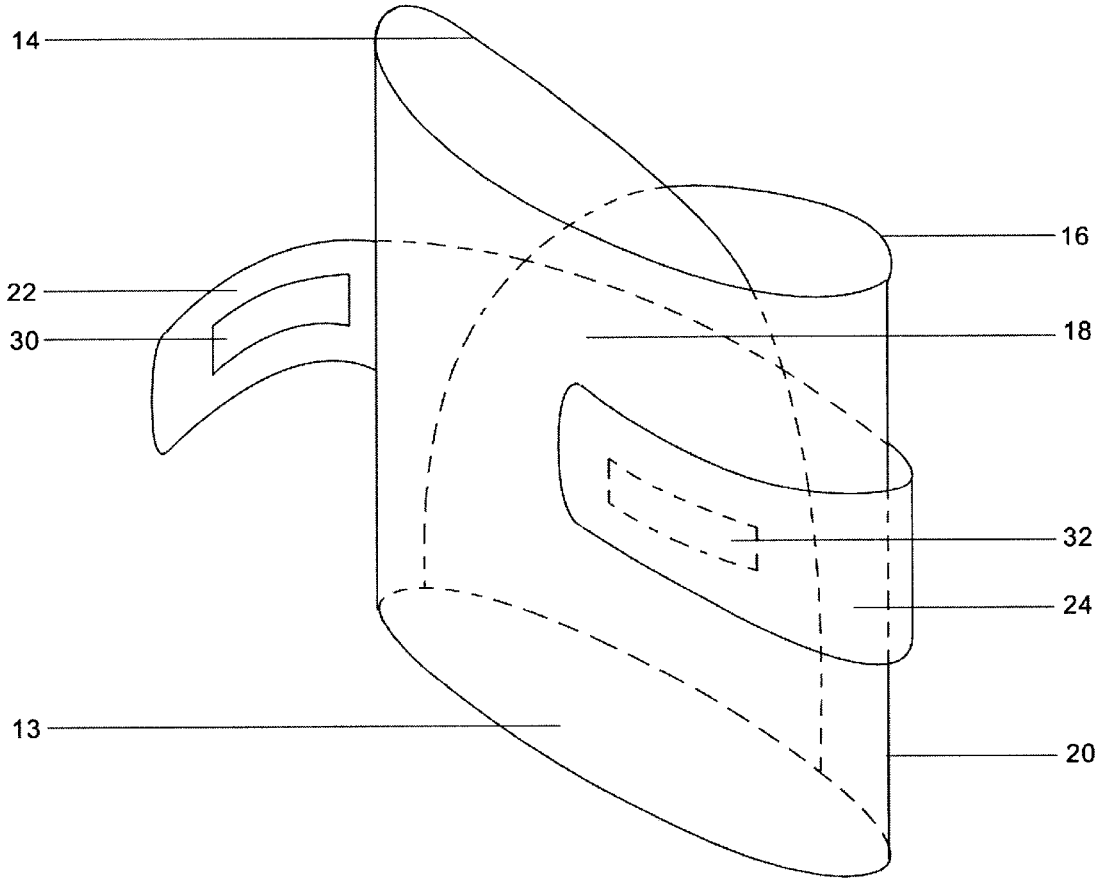
FIG. 2B is a back perspective view of FIG. 2A.
Figure 3:
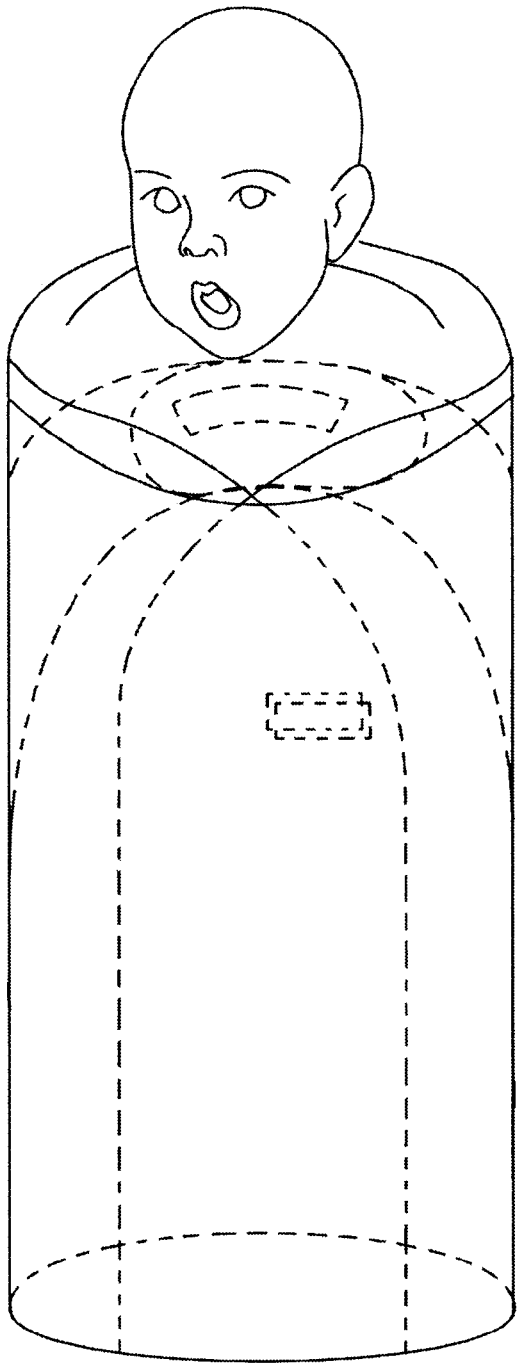
FIG. 3 is a perspective view of blanket 10.

Referring to FIG. 1B, blanket 10 is in an intermediate stage of enclosure, with right hand side 14 and left-hand side 16 in use, joined to each other by hook and loop fasteners 26 and 28. Central area 18 is shown containing an elastic band 25. Central area 18 may contain no elastic bands, or more than one elastic band, depending on the need to secure the infant. In FIG. 2A, T-shaped wrapping flap is shown directly on top of securing compartment 12, with right securing flap 22 and left securing flap 24 still unattached. FIG. 2B is a back perspective view of blanket 10 with right securing flap 22 and left securing flap 24 just before being folded onto each other. FIG. 3 shows blanket 10 in use.

In the preferred embodiment, blanket 10 is constructed of one layer of fleece material. However, the blanket may be constructed of one or more layers of material such as cotton, cotton blend, flannel, satin, terry velour, or any other material that is soft and durable enough to take the shape of a blanket. The edges of the fabric may contain a cover stitch, satin binding, wooly nylon, or any other means in which two pieces of material may be attached.

FIGS. 4A-4B-5A-5B-6-7-Alternative Embodiments

Figure 4A:
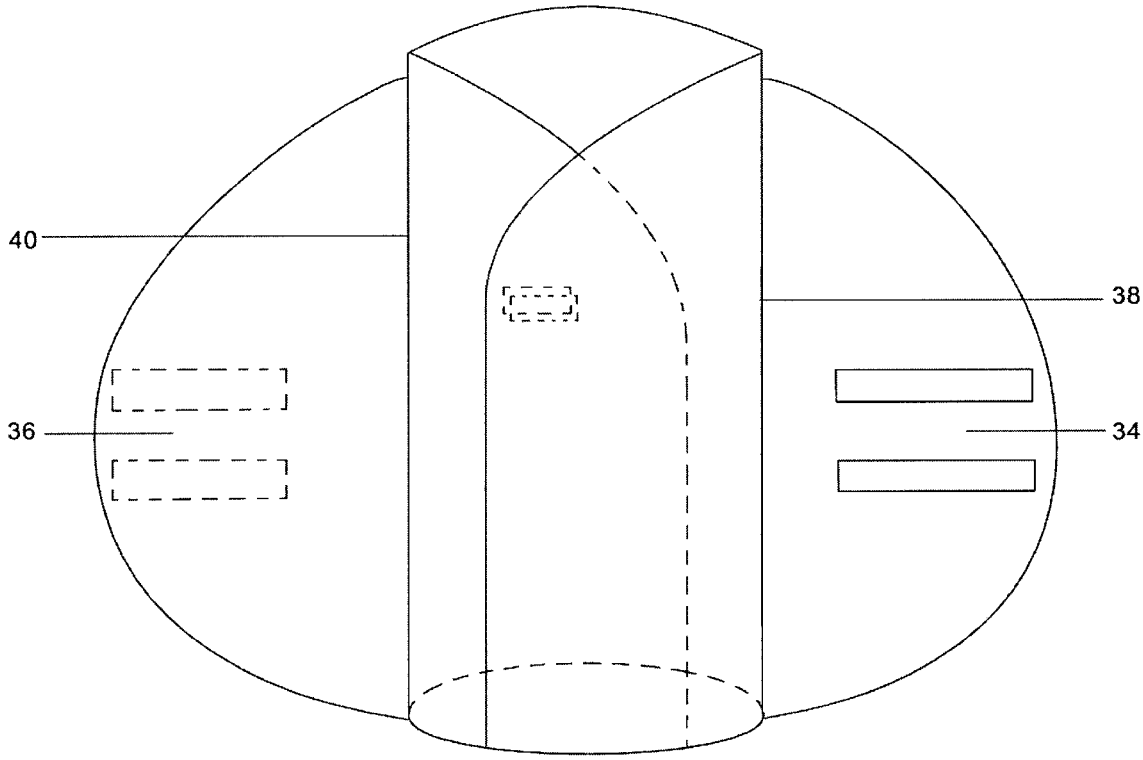
FIG. 4A is a plan view of an alternative embodiment of blanket 10.

There are various possibilities with regard to the relative positioning and shape of T-shaped wrapping flap 20 of blanket 10. T-shaped wrapping flap 20 may be eliminated and replaced with two additional flaps; right alternative flap 34 and left alternative flap 36, as shown in FIG. 4A. These side flaps may be from a continuous piece of material which extends around the back of securing compartment 12, or two separate pieces, individually attached to right seam 38 and left seam 40. The right alternative flap 34 and the left alternative flap 36 may each contain at least one hook and loop fastener.

Figure 4B:
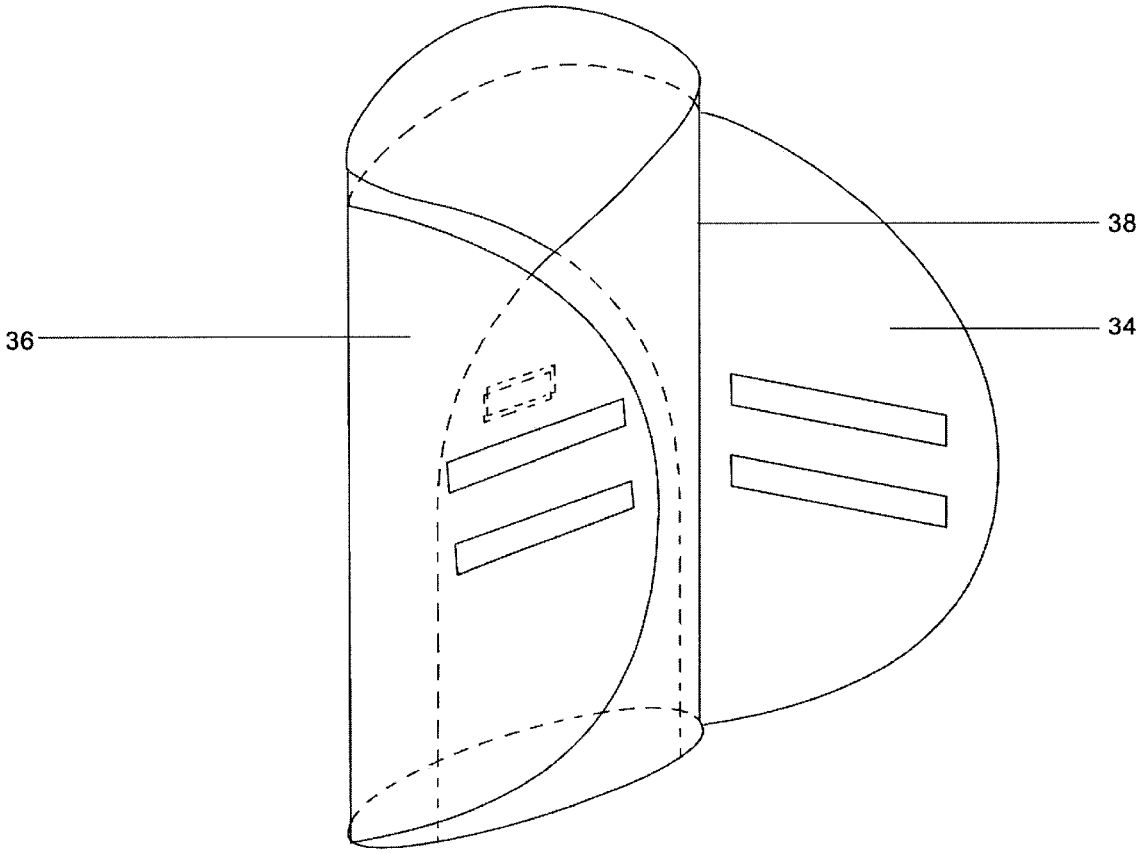
FIG. 4B is a perspective view of FIG. 4A.
Figure 5A:
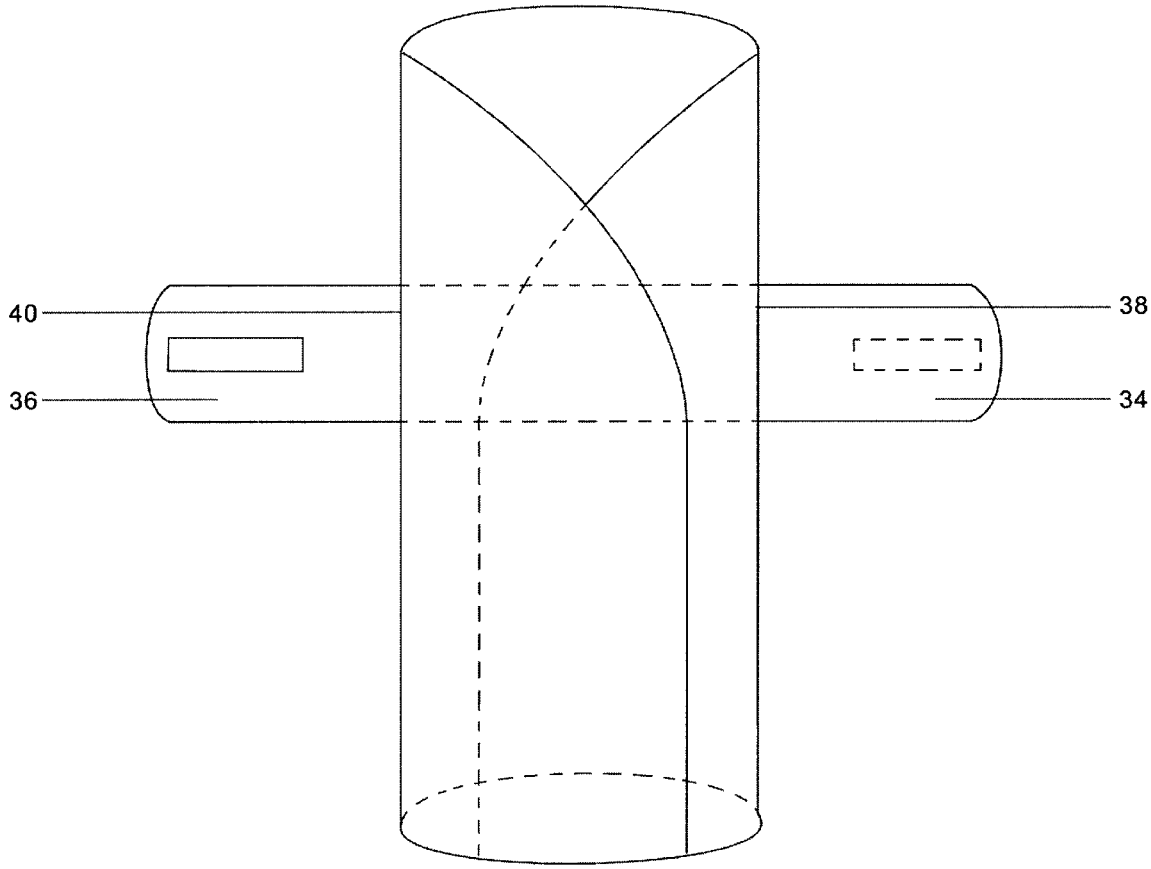
FIG. 5A is a plan view of an alternative embodiment of blanket 10.
Figure 5B:
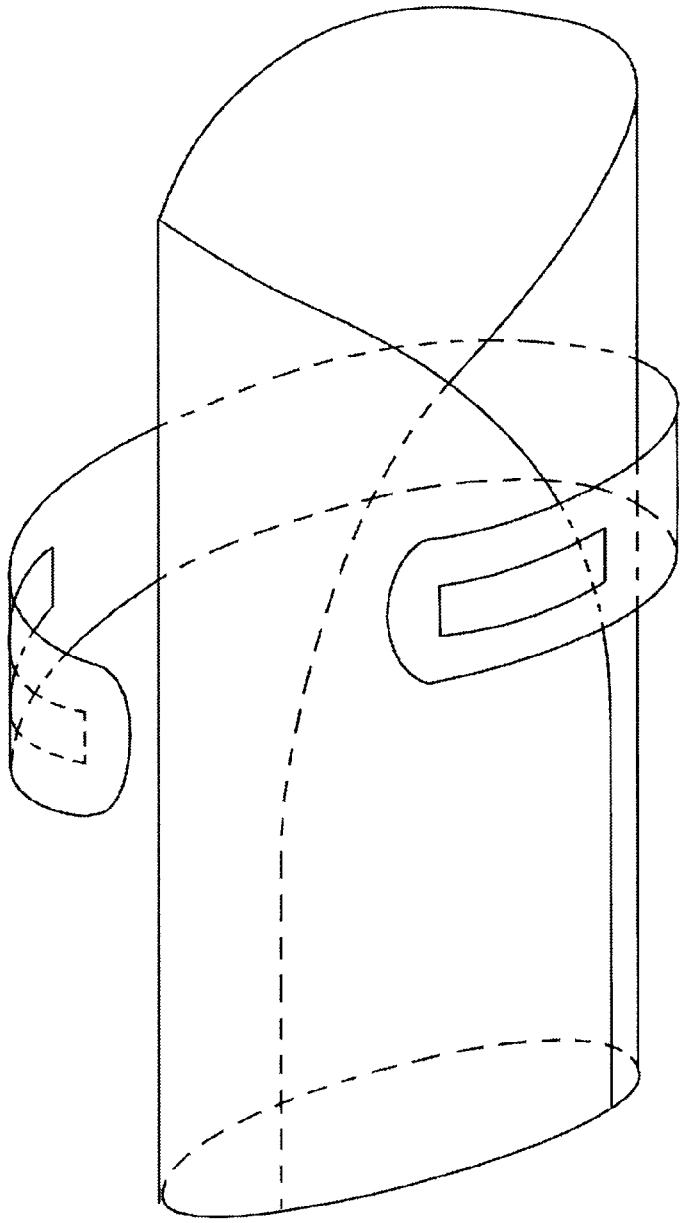
FIG. 5B is a perspective view of FIG. 5A.
Figure 6:
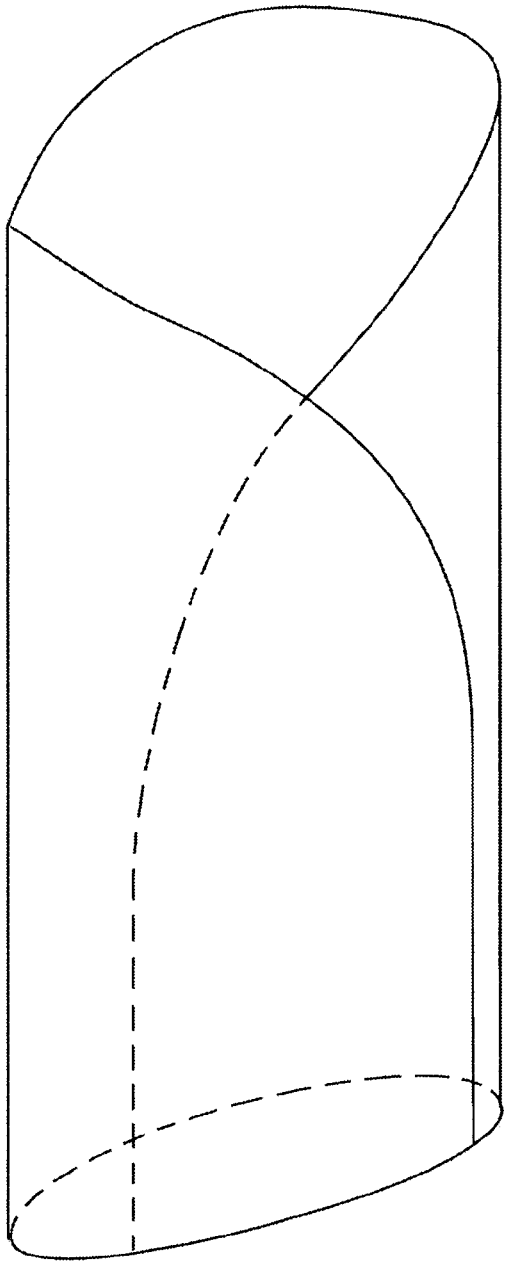
FIG. 6 is a plan view of an alternative embodiment of blanket 10.
Figure 7:
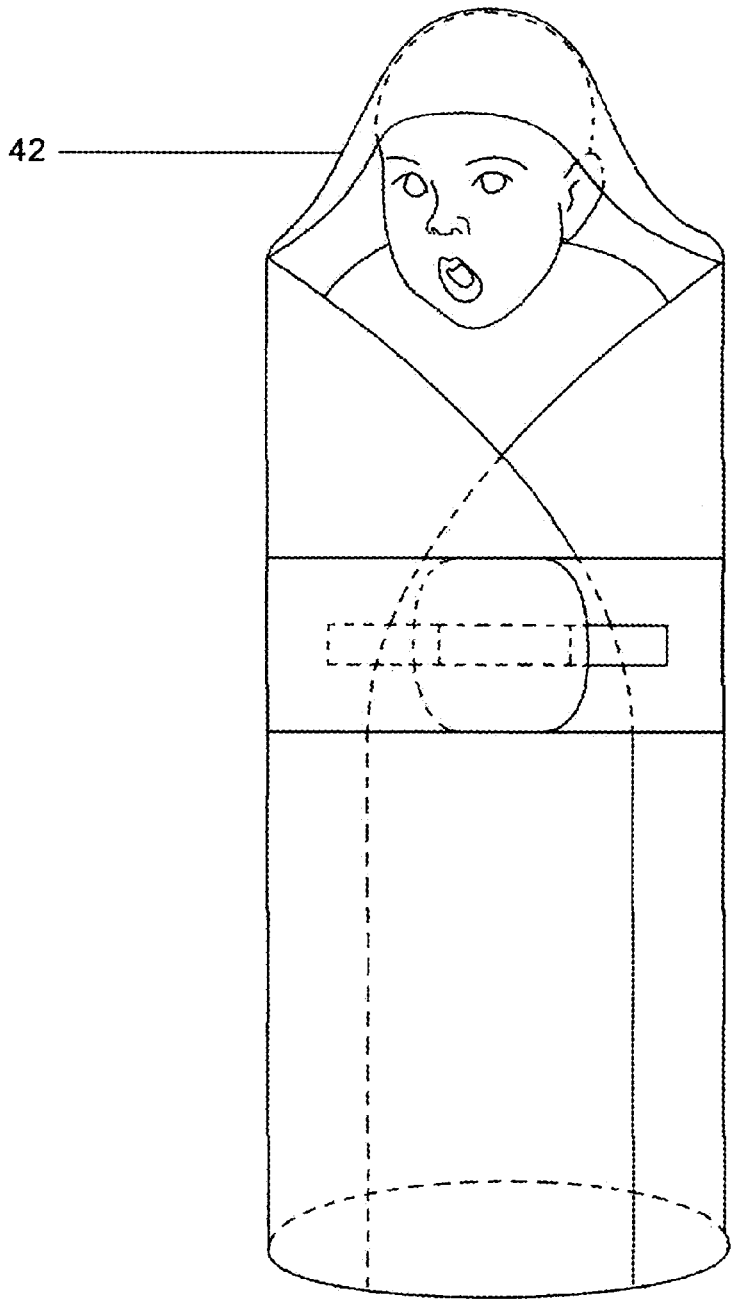
FIG. 7 is a plan view of an alternative embodiment of blanket 10 with the addition of a hood.

The alternative flaps may have many shapes and sizes, ranging from wide and oval, as shown in FIGS. 4A and 4B, to narrow and rectangular, as shown in FIGS. 5A and 5B. In FIGS. 4A, 4B, 5A, and 5B, right alternative flap 34 and left alternative flap 36 attach to each other in the front of securing compartment 12. Another alternative is to eliminate T-shaped wrapping flap 20 altogether, as shown in FIG. 6. In FIG. 7, one of the alternative embodiments of blanket 10 is shown comprising of hood 42, which can be formed using the same piece of material used in forming securing compartment 12, or added by attaching a separate piece of material to central area 18.

OPERATION

Referring now to FIG. 1A, a method for wrapping a "blanket" around an infant according to the principles of the present invention will be described. In use, an infant is placed inside securing compartment 12 with the head resting on central area 18. The arms of the infant may either be placed inside or left out of securing compartment 12. Right-hand side 14 is folded over the infant so that it covers a portion of the infant's body. Left-hand side 16 is then folded over and secured to right-hand side 14 using right hook and loop fastener 26 and left hook and loop fastener 28 to secure the infant in place. T-shaped wrapping flap 20 is then folded up and over the front of securing compartment 12. Next, right securing flap 22 and left securing flap 24 are joined in the back of securing compartment 12 and thus the back of the infant by attaching right hook and loop fasteners on T-shaped wrapping flap 30 with left hook and loop fasteners on T-shaped wrapping flap 32. Hook and loop fasteners are sewn in the appropriate overlapping regions of right-hand flap 22 and left-hand flap 24 so that when connected, the infant is secure in the blanket.

A variation to the above mentioned method would be to place the infant into the securing compartment 12 so that the waist is even with the top edge of securing compartment 12. Following the rest of the above mentioned method would allow just the infant's waist and legs to be completely covered by the blanket.

The operations of the alternative embodiments shown in FIGS. 4A, 5B, and 6 are identical to the operation of the preferred embodiment with one exception; instead of using T-shaped wrapping flap 20 to secure the infant, right alternative flap 34 and left alternative flap 36 are folded over each other in front of securing compartment 12, and thus in front of the infant, and further secured with hook and loop fasteners attached to right alternative flap 34 and left alternative flap 36.

CONCLUSION, RAMIFICATIONS, AND SCOPE OF INVENTION

Thus the reader will see that the infant sleeping and receiving blanket provides a safe and secure blanket for an infant to be comfortably swaddled in while maintaining its usefulness as the infant continues to grow.

While my above description contains many specificities, these should not be construed as limitations on the scope of the invention, but rather as an exemplification of one preferred embodiment thereof. Many other variations are possible. For example, the invention should not be limited in the following ways: in shape (the blanket may be made of a different shaped material as to form a hood for the blanket), in size (this blanket may be used for adults, or for premature infants), the type of material of manufacture (hospitals may have use for a soft paper version for intensive care babies), in use (this blanket may be manufactured as a toy blanket for dolls or teddy bears), means of fastening material together (this includes a number of materials besides traditional thread), orientation (right side may fold over left side first, or left side may fold over right side first), and location of securing flaps.

Accordingly, the scope of the invention should be determined not by the embodiments illustrated, but by the appended claims and their legal equivalents.

Having thus disclosed my invention, what I claim as new and desire to secure by Letters of Patent of the United States is:

1. An infant securing receiving blanket comprising of a securing compartment for receiving and infant, said securing compartment having a sheet of fabric of a predetermined shape, and of sufficient size to accommodate use by an infant, comprising a right hand side, a left hand side, and a central area, said left hand side and said right hand side of securing compartment having means of joining said left hand side to said right hand side, a gusset, said gusset having means for attachment to the base of the right hand side, left hand side, and central area of said securing compartment to form a completely closed blanket at the base, attached to said securing compartment at its base is a T-shaped wrapping flap, said T-shaped wrapping flap having means of attaching to said securing compartment, said T-shaped wrapping flap having left and right securing flaps, said securing flaps of said T-shaped wrapping flap having means of joining and overlapping said left securing flap to said right securing flap, whereby a newborn or older infant can be placed inside the blanket to be comfortably warm and secure.

2. The blanket in claim 1 wherein said central area of said securing compartment comprises of at least one elastically gathered transverse region.

3. The blanket in claim 1 wherein said right side and said left side comprises at least one set of mating hook and loop fasteners.

4. The blanket in claim 1 wherein said blanket may comprise of a plurality of sizes.

5. The blanket in claim 1 wherein said blanket may comprise of a plurality of materials.

6. The blanket in claim 1 wherein said blanket may comprise of a plurality of layers.

7. The blanket in claim 1 wherein said blanket may comprise of a hood.

8. An infant securing receiving blanket comprising of a securing compartment for receiving an infant, said securing compartment having a sheet of fabric of a predetermined shape, and of sufficient size to accommodate use by an infant, comprising a right hand side, a left hand side, and a central area, said left hand side and said right hand side of securing compartment having means of joining said left hand to said right hand side, a gusset, said gusset having means for attachment to the base of the right hand side, left hand side, and central area of said securing compartment to form a completely closed blanket at the base, wherein said central area of said securing compartment comprises of at least one elastically gathered transverse region, attached to said securing compartment on its right hand side is at least one right alternative flap, attached to said securing compartment on its left hand side is at least one left alternative flap, said right alternative flap having means of attaching said right alternative flap to said right hand side, said left alternative flap having means of attaching said left alternative flap to said left hand side, said right alternative flap and said left alternative flap having means of joining and overlapping said right alternative flap with said left alternative flap, said right alternative flap and said left alternative flap comprised of sufficient size and shape to be wrapped over the shoulders, arms, girth, or waist of an infant, whereby a blanket is provided which can be easily manipulated to form a secure and snug wrapping around an infant, and a newborn or older infant can be placed inside the blanket to be comfortably warm and secure.

9. The blanket in claim 8 wherein said blanket may comprise of a hood.

10. An infant securing receiving blanket comprising of a securing compartment for receiving and infant, said securing compartment having a sheet of fabric of a predetermined shape, and of sufficient size to accommodate use by an infant, comprising a right hand side, left hand side, and a central area, wherein said central area of said securing compartment comprises of at least on elastically gathered transverse region, said left hand side and said right hand side of securing compartment having means of joining said left hand side to said right hand side, a gusset, said gusset having means for attachment to the base of the right hand side, left hand side, and central area of said securing compartment to form a completely closed blanket at the base, whereby a blanket is provided which can be easily manipulated to form a secure and snug wrapping around the infant.

11. The blanket in claim 10 wherein said blanket may comprise of a hood.

* * * * *